US005643515A

United States Patent [19]

Davies

[11] Patent Number: 5,643,515

[45] Date of Patent: Jul. 1, 1997

[54] METHOD AND APPARATUS FOR PRODUCING STRETCHED YARNS

[75] Inventor: John Davies, Cesate, Italy

[73] Assignee: Filteco S.p.A., Milan, Italy

[21] Appl. No.: 455,118

[22] Filed: May 31, 1995

[30] Foreign Application Priority Data

Jun. 8, 1994 [IT] Italy ..... MI94A1189

[51] Int. Cl.[6] ..... D01D 5/16; D02G 1/16

[52] U.S. Cl. ..... 264/103; 28/240; 28/271; 264/130; 264/210.7; 264/210.8; 264/211.12; 264/211.14; 425/66; 425/93; 425/94; 425/104; 425/363; 425/464

[58] Field of Search ..... 264/103, 130, 264/168, 210.7, 210.8, 211.12, 211.14; 425/66, 93, 94, 104, 363, 464; 28/240, 271; 57/310, 350

[56] References Cited

U.S. PATENT DOCUMENTS

| | | | |
|---|---|---|---|
| 4,851,172 | 7/1989 | Rowan et al. | 264/130 |
| 4,902,462 | 2/1990 | Bert | 264/103 |

OTHER PUBLICATIONS

"The Drawing of 'Terylene'", I. Marshall and A. B. Thompson, J. Appl. Chem, 4, Apr., 1954, pp. 145–153.

"Steam Drawing Yarns", Fredrick A. Ethridge, President, Chiron Technology, Inc., IFJ/Jun. 1989, pp. 64–68.

"Complexities in PET Tire Yarn Processing and Characterization", Dr. W. G. Perkins, Fiber Forming Polymers Research, The Goodyear Tire & Rubber Co., Akron, Ohio, IFJ/Sep. 1987, pp. 42–50.

*Primary Examiner*—Leo B. Tentoni

*Attorney, Agent, or Firm*—Wigman, Cohen, Leitner & Myers, P.C.

[57] ABSTRACT

A method and apparatus for producing stretched yarns. PET yarns composed of a plurality of continuous and substantially fully stretched individual filaments are made by melt spinning and stretching them in an integral process having the steps of (a) simultaneous extrusion of the individual filaments for forming at least eight continuous filament strands of at least about ten filaments for solidification of the filaments; (b) arranging the filaments to form a planar array of parallel and mutually distanced strands; (c) together pre-stretching the filaments by passing the strands in frictional contact with peripheral surface portions of a first and second rotating draw cylinder having parallel axes of rotation and operated at different speeds for achieving a pre-draw rate of from about 5 to about 20% of the fully stretched state, each strand passing over the surface portions along a discrete path which is defined by a plane intersecting perpendicularly with the axes of rotation of the draw cylinders; (d) continuously applying an aqueous lubricant having the temperature of at least about 50° C. to produce a continuous film of lubricant on each filament; and (e) passing the strands in contact with the peripheral surface portions of at least two additional rotating draw cylinders having an axes of rotation parallel to the first and second rotating draw cylinders and operating at differing speeds for achieving full stretch of the filaments.

9 Claims, 1 Drawing Sheet

METHOD AND APPARATUS FOR PRODUCING STRETCHED YARNS

FIELD OF INVENTION

The invention generally relates to the production of yarns consisting of man-made fibres and specifically to a method and an apparatus for producing yarns of polyethylene terephthalate in an integral melt spinning and drawing process.

BACKGROUND OF THE INVENTION

During a first phase of the development of synthetic fibres made of polyethylene terephthalate (termed PET herein for short) such fibres were produced in a two-stage process. In the first stage, substantially amorphous fibres were made by melt spinning, and were fully stretched in the second stage on a separate machine, cf. Marshall et al in J. Appl. Chem, 4 (1954), pages 145–153.

Even during that stage, heating of the filaments by contact with one or more solid surfaces was believed to be essential for maximum stretching and, hence, molecular orientation and high tensile strength. Apparently, it is the relative rigidity of the polymer chain of PET caused by the phenylene moieties that is at the root of the problems connected with molecular orientation of PET filaments upon stretching.

Upon further development of this technology, pre-oriented yarns (POY) were produced in the first stage but full stretching still required a second stage and a separate machine. More recently, use of superheated steam has been suggested as a means for improving yarn drawing technology (e.g. as reported by Ethridge F.A. et al; IFJ June 1989, pages 64–68.).

While PET yarn production has been and important field of technology of man-made fibres ever since PET became available in commercial quantities, the importance has increased substantially with the advent of PET as a replacement for glass bottles and the consequent problems of recycling ever increasing quantities of PET scrap. While PET in virgin state already tends to cause processing problems, use of feed materials containing, or even consisting of, PET scrap and subsequent problems of thermally degraded polymer materials seemed to indicate that melt spinning was-not a promising avenue for re-use of PET. On the other hand, polymer fibre production methods tend to generate more valuable products than most other methods of polymer processing.

Accordingly, it is a main object of the invention to provide for a method of producing PET yarns even when the feed stock contains substantial amounts of recycled PET.

Other objects will become apparent as this specification proceeds.

SUMMARY OF THE INVENTION

I have found that these objects can be achieved in a surprisingly effective manner by applying teachings from a different technology and modifying them in a relatively simple manner.

Specifically, I have found that prior art methods and apparatus means for resolving the problem of "draw resonance" when melt spinning and stretching polypropylene fibres as disclosed by P. Bert in U.S. Pat. No. 4,902,462 can be applied in the production of substantially fully stretched PET yarns by an integral method (i.e.operated continuously in a single plant) if the PET filaments obtained by melt spinning are first pre-stretched and then fully stretched in the presence of an aqueous lubricating agent.

Accordingly, a first embodiment of the present invention provides for a method of producing polyethylene terephthalate yarns composed of a plurality of continuous and substantially fully stretched individual filaments by melt spinning and stretching them in an integral process comprising the steps of (a) simultaneously extruding a sufficient number of said individual filaments for forming at least eight continuous filament strands, each consisting of at least about ten filaments into an essentially vertical air quenching zone for solidification of said filaments;

(b) arranging said filaments to form a substantially planar array of parallel and mutually distanced strands in a number corresponding to step (a);

(c) together pre-stretching said filaments by passing said yarn strands, while maintaining them in said array, in frictional contact with peripheral surface portions of a first and a second rotating draw cylinder, said first and said second rotating draw cylinder having parallel axes of rotation and being operated at differing speeds for achieving a pre-draw rate of from about 5 to about 20% of said substantially fully stretched state, each strand passing over said surface portions along a discrete path which is substantially defined by a plane intersecting perpendicularly with said parallel axes of rotation of said at least two rotating draw cylinders;

(d) continuously applying onto said strands an aqueous lubricant having a temperature of at least about 50° C. so as to produce an essentially continuous film of said lubricant on each of said filaments; and (e) passing said strands from said bath, while maintaining them in said array, in contact with peripheral surface portions of at least of at least two additional rotating draw cylinders having axes of rotation parallel to said first and said second rotating draw cylinders and being operated at differing speeds for achieving said substantially full stretch of said filaments, each said strand passing over said surface portions along a discrete path which is substantially defined by a plane intersecting perpendicularly with said parallel axis of rotation of said at least two additional rotating draw cylinders.

The terms "fully stretched" or "substantially fully stretched" as used herein are intended to refer to the maximum degree of stretching that can be obtained under operating conditions of the present method with a given PET feed stock short of yarn rupture. For example, when a given PET stock extruded as an essentially unstretched filament can be stretched or "drawn" by a factor of 3.0 (meaning three times the length after stretching without rupturing) but ruptures when stretched by a factor of 3.3 it would be assumed to be "substantially fully stretched" herein. By the same token, a pre-stretching rate of form 5 to 10% indicates stretching by a factor of 1.15–1.30.

Further, the term "strand" is used herein to refer to a group, bundle or band of filaments which will ultimately form a yarn; in other words, the term "strand" implies neither coherence nor any particular structure which may, or may not, be achieved by a texturizing step subsequent to achieving substantially full stretch.

Preferred embodiments of the invention will now be discussed in connection with the individual steps enumerated above.

Figure 1:
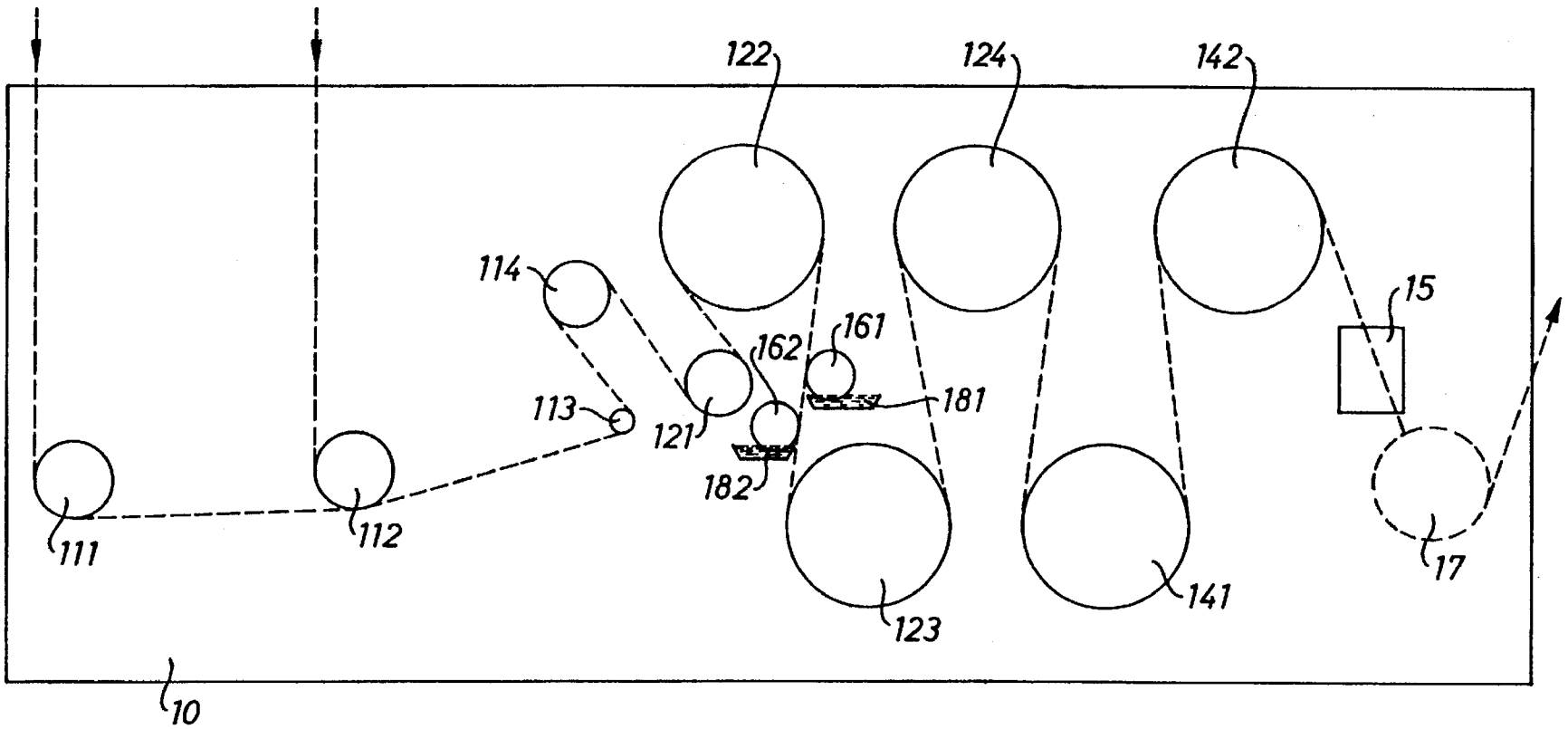
FIG. 1 shows a schematic side view of an apparatus according to the invention.

DETAILED DESCRIPTION OF THE INVENTION (a) Extrusion of the Filaments

In this first step of the inventive process a multiplicity of filaments is extruded simultaneously, e.g. by means of a number of conventional extruders as produced by ICMA San Giorgio, through conventional manifolds and filters through one or more conventional spinning beams. For commercial reasons it is essential that a sufficiently large number of yarns can be produced by means of a single integral apparatus, and it is assumed that a commercially viable machine for operating the integral method according to the invention should be capable of continuously producing at least eight continuous filament yarns, each consisting of at least about 10 and typically from about 20 to about 200 filaments.

Obviously, the total number of filaments is determined by the number of spinning orifices which, in turn, may be a function of the number of spinning plates in the beam or beams.

As indicated above, it is believed to be an important advantage of the present invention that PET feedstocks containing up to 100% by weight of PET scrap can be used in the method according to the invention. The term "scrap" is used herein to refer to a commercial grade PET that has been heated to processing temperatures of typically 200°–250° C. at least once before being again used as a feed stock in the present process. Obviously, some thermal degradation occurs in any melting of PET and degradation can proceed to the point where the PET becomes coloured or turbid. Accordingly, a suitable simple criterion for selecting a suitable feed-stock for the present invention is a water-clear and uncoloured appearance.

Conventional stabilizers, colours, pigments, additives including stabilizers etc. can be added to the feed stock.

Extrusion generally is effected into an essentially vertical air quenching zone for solidification; preferably, the filaments formed by extrusion are passed through a free vertical path including said the quenching zone and extending from a point of extrusion to a point of first contact with a mechanical yarn guiding means, said free path having a length in the range of from about 2.5 meters to about 7.5 meters.

(b) Planar Array

The filaments are now arranged so as to form a substantially planar array (used synonymously with "pattern") of parallel and mutually distanced yarn strands in a number corresponding to the selection in step (a). This array is maintained essentially through the entire length of the path of the filaments up to a point at which they have been fully stretched, optionally texturized and wound up as coils; yarn breakage control and repair can be greatly facilitated when all yarn strands are accessible on wide cylinders or rolls as contemplated by the invention.

Generally, the array can be achieved by collecting multiplicities of filaments to form a plurality of groups or strands, e.g. by conventional yarn guides such as collectors or wire loops. Preferably, all strands include the same number of filaments. Specific selection of the number of filaments per strand depends upon the denier of the filaments and the count (or filament number) of each strand. In general, the planar array will be established upon contact with the first rotating cylinder discussed in more detail below. Typically, all strands of the array will be essentially "flat" in the sense that each strand in contact with the rotating cylinders will have a "width" (i.e. it's dimension in axial direction) that is greater than it's "thickness" (i.e. the strand's dimension in radial direction).

(c) Pre-Stretching

It is believed to be essential that the solidified PET filaments be pre-stretched by passing the strands, while maintaining them in array, in frictional contact over peripheral surface portions of a first and a second rotating draw cylinder; the first and the second rotating cylinder have substantially parallel axes of rotation and are operated at slightly differing speeds so as to achieve in the filaments that pass from the second rotating cylinder have been subjected to a pre-draw rate of typically from about 5 to about 10%, preferably about 6%, of the fully stretched state (expressed as a numeric value).

Each strand is passed over surface portions of the first and second draw cylinders along a discrete path which is substantially defined by a plane intersecting perpendicularly with the parallel axes of rotation of the at least two rotating cylinders. Both the first and the second cylinder have diameters of at least about 150 mm and a width commensurate with the number of strands and a minimum distance between adjacent strands of at least about 10 mm.

Typically, these cylinders are arranged at a distanced of not more than about one or two diameters. The cylinders need not be heated but temperature control may be of advantage.

While more than two rotating cylinders could be used for the pre-stretching step it is believed that in typical operation no particular advantages would be achieved if pre-stretching is effected on more than two adjacently rotating cylinders.

(d) Aqueous Lubricant

It has been found according to the invention that final stretching, i.e. achieving maximal draw and orientation, of PET filaments by applying an aqueous lubricant onto the strands so as to form continuous lubricant films on each filament prior to full stretching.

While not wishing to be bound to any specific theory it is believed that treatment with the aqueous lubricant counteracts the normal tendency of the draw-point of PET filaments to positionally oscillate so that the main draw-point will occur at a controlled position in space, preferably between the two cylinders immediately subsequent to the site of application of the aqueous lubricant.

A "lubricant" in the sense of the present invention is a substance capable of reducing friction between the filaments and the rotating draw cylinders. The lubricant should be "aqueous", i.e. contain a major portion of water or consist of water. Water is preferred since it can be easily removed from the filaments, e.g. by means of heat. Minor amounts of additives including oils, surfactants and the like substances can be added but this is not always preferred. The aqueous lubricant is applied at an elevated temperature, i.e. at least about 50° C. and preferably at a temperature of from about 80° to about 90° C. so as to avoid undesirable cooling of the filaments. Accordingly, heating and/or temperature control of the surface of the draw cylinders may be advantageous for maintaining reproducible operating conditions. Use of demineralized water is optional but tap water qualities are suitable with low or normal degrees of water hardness.

Application of the aqueous lubricant onto the filaments can be achieved in various ways including passage of the strands trough a water bath. Spraying is another application method. According to a preferred embodiment, the aqueous lubricant is applied by means of one or two rollers rotating in a dish, tray, trough or similar container connected with a source of water and including heat control means.

(e) Full Stretch

After application of the aqueous lubricant the strands are passed while still in planar array in contact over peripheral surface portions of at least two additional rotating draw cylinders (also termed full-stretch cylinder herein for brevity) having an axis of rotation parallel to the first and the second rotating cylinder and being operated at a speed sufficient for achieving substantially full stretch of the filaments. A portion at least of the final stretch is achieved when the lubricated filaments are in physical contact with surface portions of the full-stretch cylinders.

The planes of the path of each filament or strand in contact with full-stretch-cylinders intersects perpendicularly with the parallel axis of rotation of this and any additional cylinder in the full-stretch treatment.

The surface temperature of the full-stretch cylinders is maintained at a preferably constant value in the range of from about 75° C. to about 95° C.

Typically, the full-stretch cylinders have a relatively large diameter of at least about 300 mm while the width (or length in axial direction) is substantially the same as that of the pre-stretch cylinders.

According to a preferred embodiment, a number of full-stretch cylinders is put into contact with the filaments after application of the aqueous lubricant. Rotational speeds are of the full-stretch cylinders are adjusted such that the main stretching is effected between the second and the third cylinder, i.e. between cylinders 123 and 124. Additional cylinders operating at substantially equal or slightly increasing speeds (i.e. effecting no further stretching) may be provided for stabilization and stretch control purposes.

The invention, in a second embodiment thereof, further provides for an apparatus for simultaneously producing a plurality of polyethylene terephthalate yarns composed of a multiplicity of continuous and substantially fully stretched individual filaments by melt spinning and stretching them in an integral process comprising:

(a) means for simultaneously extruding a sufficient number of said individual filaments for forming at least eight continuous filament yarns, each consisting of at least about ten filaments, at an extrusion speed of at least 400 meters per minute into an essentially vertical air quenching zone for solidification of said filaments;

(b) means for arranging said filaments to form a substantially planar array of parallel and mutually distanced strands in a number corresponding to step (a);

(c) means for together pre-stretching said filaments by passing said strands, while maintaining them in said array, in frictional contact over peripheral surface portions of a first and a second rotating draw cylinder, said first and said second rotating draw cylinder having parallel axes of rotation and being adapted to operate at differing speeds for achieving a pre-draw rate of from about 5 to about 20% of said substantially fully stretched state, each strand passing over said surface portions along a discrete path which is substantially defined by a plane intersecting perpendicularly with said parallel axes of rotation of said at least two rotating cylinders;

(d) means for continuously applying onto said strands an aqueous lubricant having a temperature of at least about 50° C. so as to produce an essentially continuous film of said aqueous lubricant on each of said filaments; and (e) means for passing said yarn strands provided with said aqueous lubricant, while maintaining them in said array, in contact with peripheral surface portions of at least two additional rotating draw cylinders having an axes of rotation parallel to said first and said second rotating draw cylinder and being adapted for operation at speeds sufficient for achieving said substantially full stretch of said filaments, each said strand passing over said surface portions along a discrete path which is substantially defined by a plane intersecting perpendicularly with said parallel axis of rotation of said at least two additional rotating draw cylinders.

According to a third embodiment the invention provides for a method of simultaneously stretching a plurality of yarn strands each composed of a multiplicity of continuous and substantially fully stretched individual filaments formed of a synthetic organic polymer composition which may but need not be an organic polyester; the method comprises the steps of providing a sufficient number of said individual filaments for forming at least eight continuous filament strands each consisting of at least about ten filaments, and further processing essentially as in method steps (b) to (d) explained above in connection with PET stretching.

Finally, a fourth embodiment of the invention provides an apparatus for simultaneously stretching a plurality of yarn strands each composed of a multiplicity of continuous and substantially fully stretched individual filaments formed of a synthetic organic polymer composition which may but need not be an organic polyester; such apparatus comprises (a) means for providing a sufficient number of said individual filaments for forming at least eight continuous filament strands each consisting of at least about ten filaments as well as means (b) to (d) essentially as defined above for the PET processing apparatus.

Referring now to FIG. 1 of the drawings, a first group of PET filaments obtained by melt-spinning in a conventional manner (not shown) from a spinning beam is fed in the direction of arrow A onto a deflecting roller 111 so as to form four spaced strands each consisting of 100 to 200 filaments. A second group of PET filaments obtained in the same manner from a spinning beam is fed onto and around deflecting roller 112 to form a second group of four distanced strands so that a total of eight distanced strands is obtained as a planar array on roller 112.

The array so formed passes from roller 112 around to additional deflecting rollers 113, 114 and is passed around a rotating first pre-stretching cylinder 121 and to a second rotating pre-stretch cylinder 122. Typically, the rotational speed of cylinder 122 is about 10% greater than the rotational speed of cylinder 121.

While rollers 113, 114, and 121 as depicted herein are indler rolls they can also be larger cylinders and be heated and driven. In fact, this is preferred for a number of applications.

In the embodiment shown in FIG. 1, all cylinders and rollers supported by frame 10 rotate in the direction of the passing strands; rollers 111,112, 113 and the first application roller 161 as well as cylinders 121,123 and 141 rotate counter-clockwise whereas cylinders 114, 122, 124 and 142 rotate in clockwise direction. However, any or both rollers 161 and 162—the water application rollers—can be operated both co-current or counter-current with reference to the path of the strands. Counter-rotation of the water application rollers is a preferred embodiment for many applications.

Drum 17 for receiving the bulked yarn strands that emanate from a bank of conventional texturizing jets 15 rotates in counter-clockwise direction but at a lower speed. In this context it is preferred that all jets as well as any strand-heating devices used, are combined into a integral blocks for optimum uniformity of steam conditions. Also, a common drum for bulking and cooling down for all strands can be used advantageously to simplify plant design and operation.

A pair of application rollers 161, 162 is provided along the path of the array between full-stretch cylinders 122 and 123. Trays or troughs 181, 182 are provided and connected with a source of aqueous lubricant, preferably tap water, which is provided with a temperature of about 90° C. to troughs or heated and maintained therein at a temperature in the range of 80° to 90° C. Other means for applying the aqueous lubricant onto the strands for coating each filament may be used, e.g. spray nozzles and the like dispensing means. Also, more then two application rollers, or a single application roller may be used.

It is to be emphasized that the apparatus embodiment shown in the single figure is presented for illustration, not limitation, and that various modifications will be apparent to those experienced in the art.

Conventional yarn breakage controls will be used at various locations along the path of travel of the array; reference is made to U.S. Pat. No. 4,902,462 incorporated herein by reference regarding means of controlling an repairing yarn breaks.

Specific operating conditions, notably with regard to rotational speeds of the cylinders, may be optimized with regard to the denier of the filaments and yarn counts. Further, while the invention is of particular importance for processing of PET, notably in connection with recycling thereof, it is assumed that significant benefits will be obtained if synthetic organic polymers other than PET are processed according to the invention.

What is claimed:

1. A method of extruding and stretching polyethylene terephthalate yarns composed of a plurality of continuous individual filaments in an integral process comprising the steps of (a) simultaneously extruding a sufficient number of said individual filaments for forming at least eight continuous filament strands, each consisting of at least about ten filaments into an essentially vertical air quenching zone for solidification of said filaments;

(b) arranging said filaments to form a substantially planar array of parallel and mutually distanced strands in a number corresponding to step (a);

(c) together pre-stretching said filaments by passing yarn strands, while maintaining them in said array, in frictional contact with peripheral surface portions of a first and a second rotating draw cylinder, said first and said second rotating draw cylinder having parallel axes of rotation and being operated at differing speeds for achieving a pre-draw rate of from about 5 to about 20% of said substantially fully stretched state, each strand passing over said surface portions along a discrete path which is substantially defined by a plane intersecting perpendicularly with said parallel axes of rotation of said at least two rotation draw cylinders;

(d) continuously applying onto said strands an aqueous lubricant having a temperature of at least about 50° C. so as to produce an essentially continuous film of said lubricant on each side of said filaments; and (e) passing said strands provided with said lubricant, while maintaining them in said array, in contact with peripheral surface portions of at least two additional rotating draw cylinders having axes of rotation parallel to said first and said second rotating draw cylinders and being operated at differing speeds for achieving a substantially full stretch of said filaments, each said strand passing over said surface portions along a discrete path which is substantially defined by a plane intersecting perpendicularly with said parallel axis of rotation of said at least two additional rotation draw cylinders.

2. The method of claim 1 wherein each of said strands is in contact with said peripheral surface portions of said rotating cylinders for a contact path length of from about 1 meter to about 6 meters, and wherein at least 50 percent of said path length of frictional contact is provided on a total number of from 3 to 6 cylinders.

3. The method of claim 2 wherein said at least two additional rotating draw cylinders each have a diameter greater than about 300 mm.

4. The method of claim 1 wherein said filaments formed in step (a) are passed through a free vertical path including said air quenching zone and extending from a point of extrusion to a point of first contact with a mechanical yarn guiding means, said free path having a length in the range of from about 2.5 meters to about 7.5 meters.

5. The method of claim 1 comprising texturing fully stretched strands for forming bulk yarns and winding them at a speed of at least about 1000 meters per minute.

6. The method of claim 1 wherein said individual filaments in step (a) are extruded at a speed of at least 400 meters per minute.

7. An apparatus for extruding and stretching a plurality of polyethylene terephthalate yarns composed of a multiplicity of continuous individual filaments in an integral process comprising:

(a) means for simultaneously extruding a sufficient number of said individual filaments for forming at least eight continuous filament yarns, each consisting of at least about ten filaments, at an extrusion speed of at least 400 meters per minute into an essentially vertical air quenching zone for solidification of said filaments;

(b) means for arranging said filaments to form a substantially planar array of parallel and mutually distanced strands in a number corresponding to step (a);

(c) means for together pre-stretching said filaments by passing said strands, while maintaining them in said array, in frictional contact over peripheral surface portions of a first and a second rotating draw cylinder, said first and said second rotating draw cylinder having parallel axes of rotation and being adapted to operate at differing speeds for achieving a pre-draw rate of from about 5 to about 20% of said substantially fully stretched state, each strand passing over said surface portions along a discrete path which is substantially defined by a plane intersecting perpendicularly with said parallel axes of rotation of said at least two rotating cylinders;

(d) means for continuously applying onto said strands an aqueous lubricant having a temperature of at least about 50° C. so as to produce an essentially continuous film of said aqueous lubricant on each of said filaments; and (e) means for passing yarn strands provided with said aqueous lubricant, while maintaining them in said array, in contact with peripheral surface portions of at least two additional rotating draw cylinders having axes of rotation parallel to said first and said second rotating draw cylinder and being adapted for operation at speeds sufficient for achieving said substantially full stretch of said filaments, each said strand passing over said surface portions along a discrete path which is substantially defined by a plane intersecting perpendicularly with said parallel axis of rotation of said at least two additional rotating draw cylinders.

8. A method of simultaneously stretching a plurality of yarn strands each composed of a multiplicity of continuous and substantially fully stretched individual filaments formed of a synthetic organic polymer composition, said method comprising the steps of:

(a) providing a sufficient number of said individual filaments for forming at least eight continuous filament strands each consisting of at least ten filaments;

(b) arranging said filaments to form a substantially planar array of parallel and mutually distanced strands in a number corresponding to step (a);

(c) together pre-stretching said filaments by passing yarn strands, while maintaining them in said array, in frictional contact with peripheral surface portions of a first and a second rotating draw cylinder, said first and said second rotating draw cylinder having parallel axes of rotation and being operated at differing speeds for achieving a pre-draw rate of from about 5 to about 20% of said substantially fully stretched state, each strand passing over said surface portions along a discrete path which is substantially defined by a plane intersecting perpendicularly with said parallel axes of rotation of said at least two rotating cylinders;

(d) continuously applying onto said strands an aqueous lubricant having a temperature of at least about 50° C. so as to produce an essentially continuous film of said lubricant on each of said filaments; and (e) passing said strands provided with said aqueous lubricant, while maintaining them in said array, in contact with peripheral surface portions of at least two additional rotating draw cylinders having axes of rotation parallel to said first and said second rotating draw cylinders and being operated at differing speeds for achieving said substantially full stretch of said filaments, each said strand passing over said surface portions along a discrete path which is substantially defined by a plane intersecting perpendicularly with said parallel axis of rotation of said at least two additional rotating draw cylinders.

9. An apparatus for simultaneously stretching a plurality of yarn strands each composed of a multiplicity of continuous and substantially fully stretched individual filaments formed of a synthetic organic polymer composition, said apparatus comprising:

(a) means for providing a sufficient number of said individual filaments for forming at least eight continuous filament strands each consisting of at least ten filaments;

(b) means for arranging said filaments to form a substantially planar array of parallel and mutually distanced strands in a number corresponding to step (a);

(c) means for together pre-stretching said filaments by passing yarn strands, while maintaining them in said array, in frictional contact with peripheral surface portions of a first and a second rotating draw cylinder, said first and said second rotating draw cylinder having parallel axes of rotation and being adapted to operate at differing speeds for achieving a pre-draw rate of from about 5 to about 20% of said substantially fully stretched state, each strand passing over said surface portions along a discrete path which is substantially defined by a plane intersecting perpendicularly with said parallel axes of rotation of said at least two rotating cylinders;

(d) means for continuously applying onto said strands an aqueous lubricant having a temperature of at least about 50° C. so as to produce an essentially continuous film of said lubricant on each of said filaments; and (e) means for passing yarn strands provided with said aqueous lubricant, while maintaining them in said array, in contact with peripheral surface portions of at least two additional rotating draw cylinders having axes of rotation parallel to said first and said second rotating draw cylinders and being adapted to operate at differing speeds for achieving said substantially full stretch of said filaments, each said strand passing over said surface portions along a discrete path which is substantially defined by a plane intersecting perpendicularly with said parallel axis of rotation of said at least two additional rotating draw cylinders.

* * * * *